United States Patent [19]

Johdai et al.

[11] Patent Number: 4,621,803

[45] Date of Patent: Nov. 11, 1986

[54] SORTING APPARATUS OF SHIFTABLE BIN TYPE

[75] Inventors: Akiyoshi Johdai; Takuma Ishikawa, both of Toyokawa, Japan

[73] Assignee: Minolta Camera Kabushiki Kaisha, Osaka, Japan

[21] Appl. No.: 783,022

[22] Filed: Oct. 2, 1985

[30] Foreign Application Priority Data

Oct. 4, 1984 [JP] Japan ..... 59-209142

[51] Int. Cl.[4] ..... B65H 39/10

[52] U.S. Cl. ..... 271/293; 271/176; 271/199; 271/294

[58] Field of Search ..... 271/294, 258, 259, 265, 271/152, 154, 155, 157, 292, 293, 176, 199

[56] References Cited

U.S. PATENT DOCUMENTS

| | | | |
|---|---|---|---|
| 4,328,963 | 5/1982 | DuBois et al. | 271/293 |
| 4,332,377 | 6/1982 | DuBois et al. | 271/293 |
| 4,337,936 | 7/1982 | Lawrence | 271/293 |
| 4,343,463 | 8/1982 | Lawrence | 271/293 |

FOREIGN PATENT DOCUMENTS

| | | | |
|---|---|---|---|
| 56-46256 | 4/1981 | Japan . | |
| 56-144448 | 11/1981 | Japan . | |
| 42451 | 3/1982 | Japan | 271/293 |
| 216862 | 12/1983 | Japan | 271/293 |

*Primary Examiner*—Richard A. Schacher

*Attorney, Agent, or Firm*—Wenderoth, Lind & Ponack

[57] ABSTRACT

A sorting apparatus of a shiftable bin type for use in a copying apparatus or the like, which is arranged to be capable of readily and positively removing sorted copy paper sheets from respective bins.

26 Claims, 11 Drawing Figures

SORTING APPARATUS OF SHIFTABLE BIN TYPE

BACKGROUND OF THE INVENTION

The present invention generally relates to a sorter and more particularly, to a sorting apparatus of a shiftable bin type having a plurality of bins or trays (referred to as bins hereinafter) movably supported for vertical movements with respect to an end portion of a transport section adapted to receive copy paper sheets dishcarged from a copying apparatus for transport thereof in one direction.

As one example of the sorting apparatus of a shiftable bin type as referred to above, there has conventionally been proposed a sorter in U.S. Pat. No. 4,343,463 in which, for a compact construction, etc., respective bins or trays are arranged to move in such a manner that the bin confronting a copy paper sheet feed-in portion is widely spaced from the bin located immediately thereabove, while being disposed relatively close with respect to other bins when the bin is positioned at either side of the copy paper sheet feed-in position.

In the known sorter as described above, the respective bins are arranged to be close together to a compact size, while due to absence of particular consideration with respect to removal of copy paper sheets, there is a problem that a troublesome procedure is required for a problem that a troublesome procedure is required for withdrawal of the sorted copy paper sheets from the respective bins, resulting in such an inconvenience that some small sized copy paper sheets not readily noticed may be left unremoved in the bins in certain cases.

Meanwhile, in order to prevent any copy paper sheets left unremoved in the respective bins, there has also been conventionally proposed provision of a sensor means for detecting presence of copy paper sheets. For example, in Japanese Patent Laid-Open Publication Tokkaisho No. 56-46256, reflecting type sensors are provided for each of bins, while in Japanese Patent Laid-Open Publication Tokkaisho No. 56-144448, a light transmitting type sensor is provided on the sorter main body, with openings being formed in the respective bins at positions corresponding to the sensor optical axis.

The prior art arrangements as referred to above, however, still have such problems that in the former, cost increase is undesirably involved with a sufficient room not being available for space, while in the latter, a high performance sensor is required owing to the prolonged optical axis, and even when presence of the copy paper sheet is detected by the sensor, it is still required for an operator to visually check each time in which bin the copy paper sheet is left unremoved. Furthermore, there is such a possibility that the sensor may be damaged due to troubles in the functioning of the bins.

SUMMARY OF THE INVENTION

Accordingly, an essential object of the present invention is to provide a sorting apparatus of a bin shiftable type for use in a copying apparatus or the like, which is capable of readily and positively removing sorted copy paper sheets from the respective bins, with substantial elemination of disadvantages inherent in the conventional sorting apparatuses of this kind.

Another important object of the present invention is to provide a sorting apparatus of the above described type which is simple in construction and stable in functioning, and can be readily incorporated into copying apparatuses and the like at low cost.

In accomplishing these and other objects, according to one preferred embodiment of the present invention, there is provided a sorting apparatus of a shiftable bin type having a plurality of bins which successively receive copy paper sheets from a sheet outlet of the transport section for sorting thereof, inlet ends of said bins being so arranged as to move progressively past the sheet outlet in opposite directions, and a bin shifting means for shifting the respective bins so that said bins are located close together when positioned at either side of said sheet outlet, but is largely spaced from the bin located immediately thereabove when positioned to accommodate the incoming sheet from said sheet outlet, and characterized in that there are provided a first detecting means for detecting presence or absence of copy paper sheets on said bins to emit a signal, and a control means for controlling said bin shifting means in such a manner that, after completion of sorting, upon detection by said first detecting means that the copy paper sheet has been removed from the bin confronting said sheet outlet, said bin shifting means moves the subsequent bin containing the copy paper sheet to the position confronting said sheet outlet in response to the signal of said first detecting means.

More specifically, according to the present invention, during sorting, the bin in which the copy paper sheet is to be accommodated is positioned at the terminal end of the transport section with a large space being provided between said bin and the bin located immediately thereabove, thereby to feed the copy paper sheet into said bin from the terminal end of the transport section. In the manner as described above, the copy paper sheets are fed in with each of the bins being successively widely spaced from the bin immediately thereabove.

Meanwhile, upon completion of sorting, the operator first removes the copy paper sheet from the bin confronting the terminal end of the transport section, and upon detection of the above removal of the copy paper sheet by the detecting means, the subsequent bin which contains the copy paper sheet is shifted to the position facing said terminal end of the transport section. Then, the operator successively removes the copy paper sheets from the bins shifted to said position confronting the terminal end of the transport section.

It is to be noted here that, in the present invention, although the word "sorting" means the collating, i.e., to effect page arranging for copy paper sheets in a narrow sense, it also includes various other modes for classification by the use of the sorter, for example, a grouping in which the copy paper sheet for a first original document is accommodated in a first bin, that for a second original document, in a second bin, and so forth.

Accordingly, in the present invention, the operator successively removes the copy paper sheets from the bin which is widely spaced from the bin located immediately thereabove, with a consequent facilitation of the operation to a large extent. Moreover, owing to the arrangement that the subsequent bin is shifted after the copy paper sheet has been removed (i.e., after detection that the copy paper sheet has been removed), there is no possibility that the copy paper sheet is undesirably left unremoved. Furthermore, since the detecting means for the copy paper sheets on the bins may be provided only at the terminal end of the transport section, there is not any problem in terms of space, while no high performance sensor with a long optical axis is required, nor there is any possibility that the sensor may be damaged by troubles during function of the group of bins.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
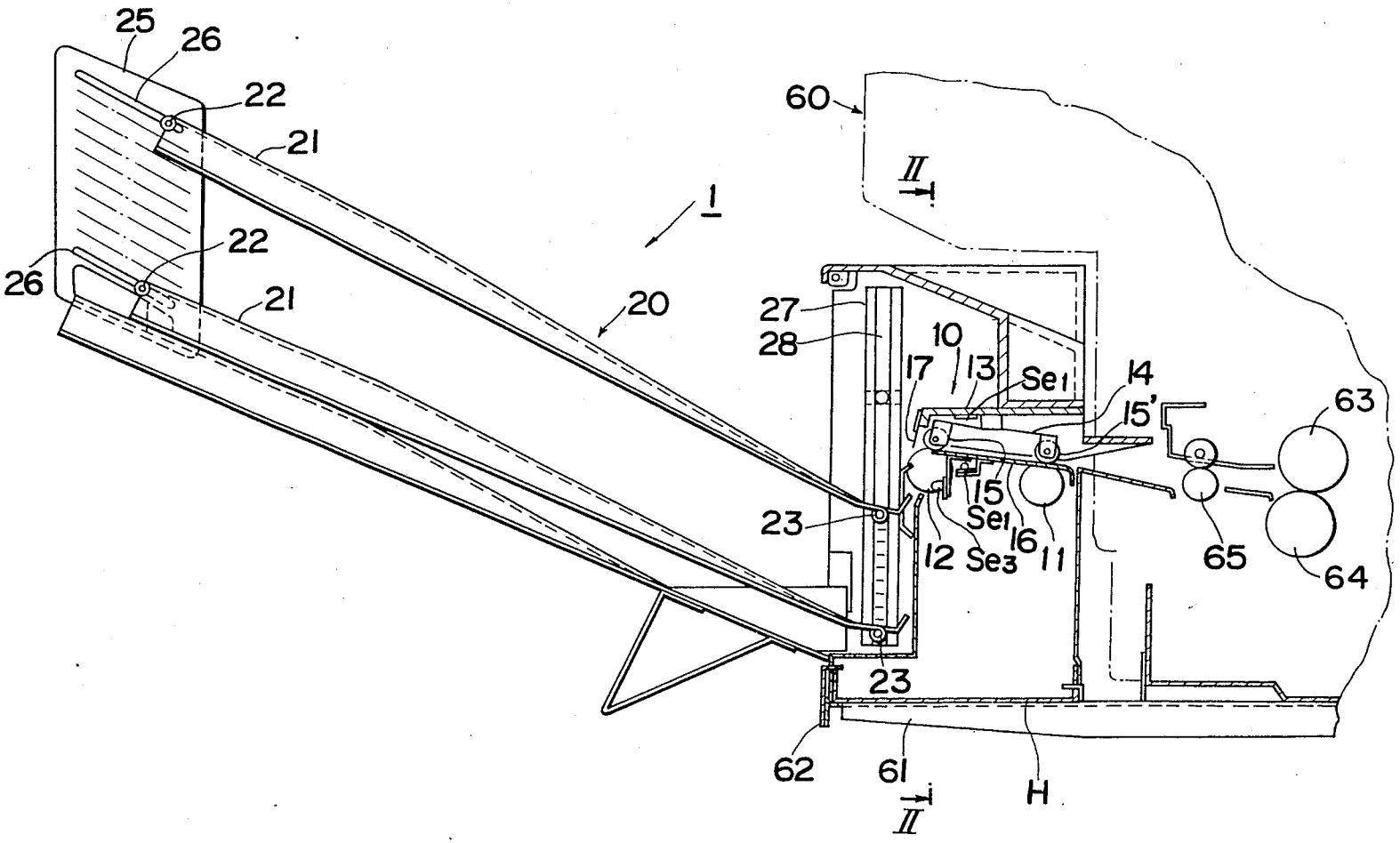
FIG. 1 is a schematic side elevational view showing internal constructions of a sorting apparatus according to one preferred embodiment of the present invention.

Before the description of the present invention proceeds, it is to be noted that like parts are designated by like reference numerals throughout the accompanying drawings.

Constructions of the Sorting Apparatus

Figure 2:
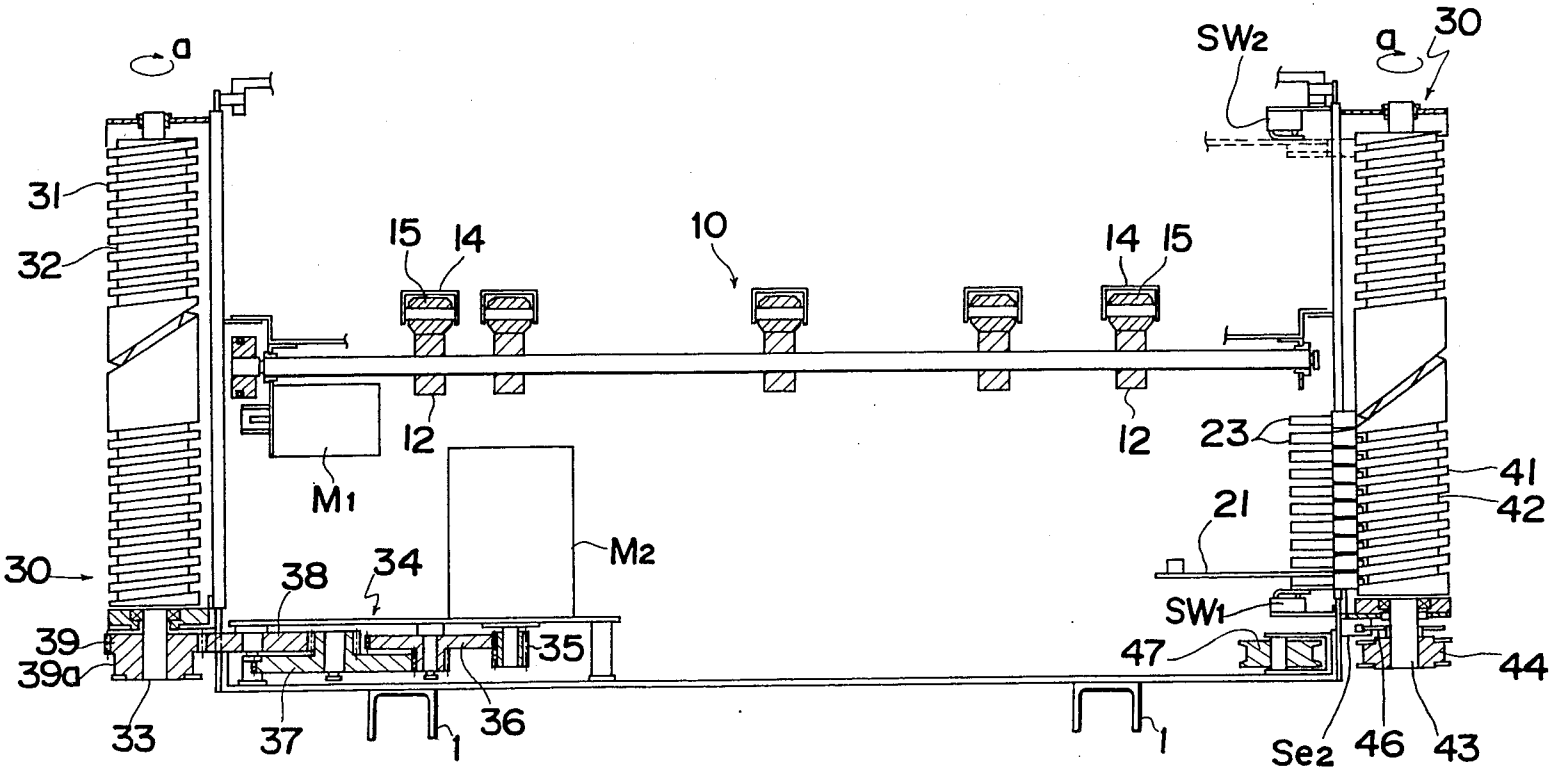
FIG. 2 is a cross section, on an enlarged scale, taken along the line II—II in FIG. 1.

Referring now to the drawings, there is shown in FIGS. 1 and 2, a sorting apparatus 1 of a shiftable bin type according to one preferred embodiment of the present invention, which generally includes a transport section 10 which receives copy paper sheets discharged from a copying apparatus 60 and transports the copy paper sheets in one direction, an accommodating section 20 provided with trays or bins 21 for accommodating the copy paper sheets therein, and a bin shifting means 30 (FIG. 2) for shifting the respective bins 21 in upward and downward directions. The sorting apparatus 1 is, for example, mounted on a support base 61 of the copying apparatus 60 and is fixed by a hook means 62 as shown.

The copy paper sheets are formed thereon with toner images through conventional processes by an image forming arrangement (not shown) in the copying apparatus 60, and fed out into the transport section 10 from a set of discharge rollers 65 through fixing rollers 63 and 64.

The transport section 10 further includes a housing H, transport rollers 11 and 12 rotatably provided in the housing H so as to be driven for rotation in the counterclockwise direction in FIG. 1 by a motor M1 (FIG. 2) through belts, gears, etc. (not particularly shown), and pinch rollers 15 and 15' held in pressure contact with said transport rollers 11 and 12 through plate springs 14 attached to a support member 13 secured to a frame of the housing H so as to be rotated following rotation of said transport rollers 11 and 12. Between the transport rollers 11 and 12, a copy paper sheet guide plate 16 is provided, while at a terminal end of the transport section 10, there is provided a charge erasing brush 17 to remove electrical charge from the copy paper sheets. Moreover, a light emitting element and a light receiving element constituting a copy paper sheet detecting sensor Se1 of a light transmitting type are respectively provided at corresponding positions on the support member 13 and the guide plate 16 so as to emit an ON signal during passage of the copy paper sheets.

Figure 3:
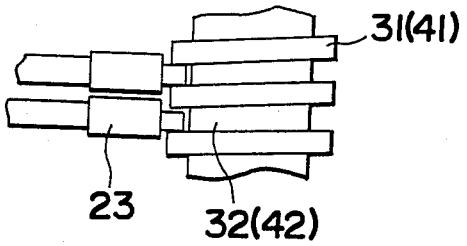
FIG. 3 is a fragmentary side elevational view for explaining engagement between a cam shaft and a trunnion in the arrangement of FIG. 2.

Meanwhile, the accommodating section 20 is provided with a plurality of the bins 21 for sorting and accommodating therein the copy paper sheets transported from the transport section 10, while two paris of trunnions 22 and 23 are respectively provided at opposite ends of each bin 21. One pair of the trunnions 22 provided at one end of each bin 21 are slidably received in elongated guide openings 26 formed in support plates 25, while the other pairs of trunnions 23 provided at the other end of each bin 21 are slidably received in spiral cam grooves 32 and 42 formed on outer peripheral surfaces of cam shafts 31 and 41 (FIG. 2) disposed at opposite sides of the housing H. The trunnions 23 are engaged with the spiral cam grooves 32 or 42 in a state as specifically shown in FIG. 3. Each of the spiral cam grooves 32 and 42 is formed to have large pitch at an intermediate stage and a small pitch at upper and lower stages and upon rotation of the cam shafts 31 and 41 in the forward direction (in the direction indicated by an arrow "a" in FIG. 2), the trunnions 23 are moved upwardly by one pitch, and thus, the bin 21 is pivoted upwardly by one pitch about the trunnions 22 at the one side thereof. On the contrary, by the rotation of the cam shafts 31 and 41 in the reverse direction (in the direction opposite to that indicated by the arrow "a"), the trunnions 23 are lowered by one pitch, and the bin 21 is pivoted downwardly by one pitch about the trunnoins 22. The intermediate portion of each cam groove 32 or 42 has only one large pitch, and when the trunnion 23 passes through this portion, the bin 21 is shifted upwardly or downwardly to a large extent, with a large space between said bin 21 and the bin located immediately thereabove. In this manner, the bin 21 widely spaced from the bin located immediately thereabove confronts the terminal end of the transport section 10 to receive the incoming copy paper sheets, and the copy paper sheets thus fed onto said bin 21 are removed therefrom in the manner as described hereinbelow.

The total number of bins 21 installed is equal to the number of cam grooves at the small pitched portions in the upper and lower stages of the cam shafts, and when all of the bins 21 are located at the small pitched portion at the lower stage (referred to as a home position hereinafter), the bin 21 at the uppermost position confronts the terminal end of the transport section 10, and the location of the bins 21 at the home position is detected by a switch SW1 provided below the lowermost bin 21. Meanwhile, when the cam shafts 31 and 41 are rotated by the same number of times as the number of the installed bins 21, all of said bins 21 are located at the small pitched portion at the upper stage of the cam shafts, which is detected by a switch SW2 provided above the uppermost bin 21.

The trunnions 23 at the other end of the respective bins 21 are slidably received in slits 28 formed in guide members 27 (FIG. 1) provided in a vertical direction for upward and downward movements so as to be restricted against displacement in the forward or backward direction.

The other trunnions 22 are intended to support the bins 21 so that the neighboring bins may not interfere with each other during the upward or downward movement of the bins 21.

On the other hand, the bin shifting means 30 includes the cam shafts 31 and 41 referred to earlier, and a driving system 34 for intermittently driving said shafts 31 and 41 for rotation, with a motor M2 capable of being driven for the forward and reverse rotations as a driving source.

Figure 4:
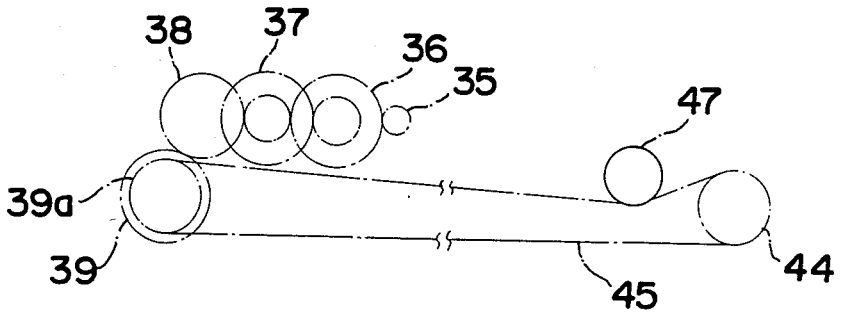
FIG. 4 is a schematic top plan view of a bin driving section.

As shown in FIGS. 2 and 4, rotation of the motor M2 is transmitted to a gear 39 fixed to a shaft portion 33 at the lower end of the cam shaft 31 from an output gear 35, through reduction gears 36 and 37 and an idle gear 38, thereby rotating the cam shaft 31 in the forward or reverse direction. Moreover, a timing belt 45 is passed between a pulley portion 39*a* of the gear 39 and a pulley 44 fixed to a shaft portion 43 at the lower end of the other cam shaft 41, thereby to rotate the cam shaft 41 in synchronization with the cam shaft 31 in the same direction. There is also provided an idle pulley 47 held in pressure contact with the timing belt 45 so as to apply a tension to said belt.

Meanwhile, each of the cam shafts 31 and 41 is intermittently driven for each one rotation as described later, and said one rotation thereof is controlled by detecting rotation of a pulse disc 46 mounted to the shaft portion 43 of the cam shaft 41, by a sensor Se2 of a light transmitting type.

Figure 5:
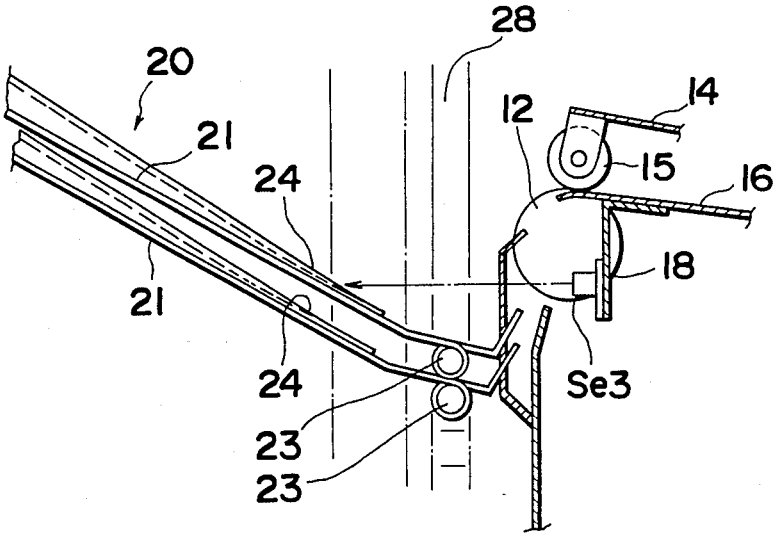
FIG. 5 is a fragmentary side sectional view showing on an enlarged scale, an essential portion of the arrangement of FIG. 1.
Figure 6:
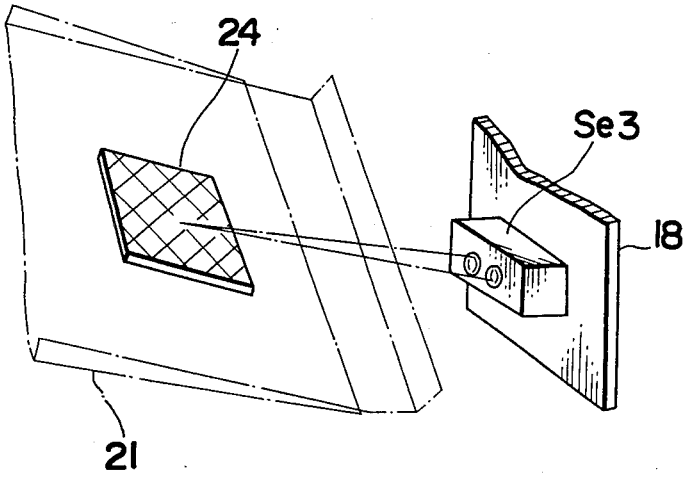
FIG. 6 is a fragmentary perspective view of the essential portion in FIG. 1.

The sorting apparatus 1 as described so far is further provided with a sensor Se3 for detecting presence or absence of the copy paper sheet on the bin 21 confronting the terminal end of the transport section 10. As shown in FIGS. 5 and 6, the above sensor Se3 is of a reflecting type attached to the reverse face of the guide plate 16 through a bracket 18, and includes a light emitting element and a light receiving element placed side by side. On the other hand, each of the bins 21 is provided with a light absorbing portion 24 at its portion confronting the sensor Se3 when it faces the terminal end of the transport section 10. The light absorbing portion 24 is formed either by applying a black sheet or by painting a black paint onto said portion. This sensor Se3 is turned off by no reflecting light in the absence of the copy paper sheet, while it is turned on by the reflecting light in the presence of the copy paper sheet. It is needless to say that the sensor Se3 is disposed at such a position as will be capable of detecting a copy paper sheet of a minimum size.

It should be noted here that the light absorbing portion 24 employed in the foregoing embodiment may be replaced by a portion having a light reflectance higher than the copy paper sheet such as a mirror, etc. so far as such a portion is provided with a light reflectance different from that of the copy paper sheet.

Control Circuit

Referring also to a block diagram of FIG. 7, control means for the sorting apparatus having the constructions as described so far will be explained hereinbelow.

Figure 7:
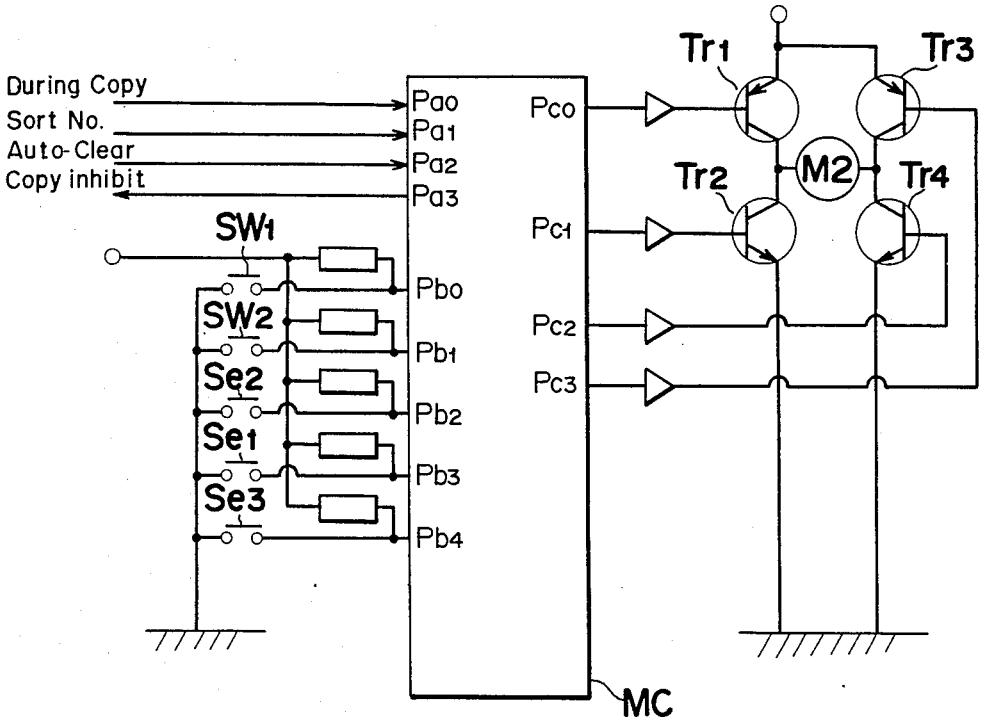
FIG. 7 is a block diagram showing construction of a control circuit for the sorting apparatus of the present invention.

In FIG. 7, the control means includes a microcomputer MC, which is provided with input/output ports Pa0, Pa1, Pa2 and Pa3 for communication with a main microcomputer (not shown) of the copying apparatus 60, in which Pa0 is an input port for a signal indicating that the copying is under way at the copying apparatus 60, the port Pa1 is an input port for sorting number, the port Pa2 is an input port for an auto-clear signal, and the port Pa3 is an output port for a copying inhibition signal, and input ports Pb0, Pb1, Pb2, Pb3 and Pb4 respectively coupled to the switches Sw1 and Sw2 and sensors Se2, Se1 and Se3 described earlier for receiving inputs therefrom, and also output ports Pc0, Pc1, Pc2 and Pc3 which are coupled to a bridge circuits constituted by transistors Tr1, Tr2, Tr3 and Tr4 to provide a driving circuit of the motor M2 for shifting the bins 21. In other words, said motor M2 is controlled for its forward or reverse rotation by the input signals from said ports Pc0 to Pc3, and is rotated in the forward direction by the ON signal from the ports Pc0 and Pc2, and in the reverse direction by the ON signal from the ports Pc1 and Pc3. In the above case, judgement is first made for the necessity to rotate the motor M2 depending on whether or not the sorting number is "1". If the sorting number is not 1 (i.e., if it is larger than 2), depending on the state of the port Pb0, i.e., depending on whether or not the bins are at the home position, the switch SW1 is turned on when the bins are at the home position, whereby the motor M2 is rotated in the forward direction, while it is rotated in the reverse direction if the switch SW1 is turned off.

Functions

Referring also to flow-charts of FIGS. 8 through 11, functions of the sorting apparatus according to the present invention will be described hereinbelow.

Figure 8:
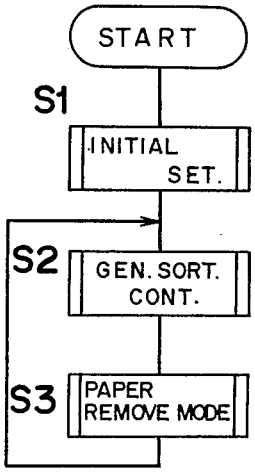
FIG. 8 through 11 are flow-charts for explaining the control to be effected by the control circuit of FIG. 7.

In FIG. 8 showing a main routine of the sorting apparatus, an initial setting of the micro-computer MC is effected at step S1, and at step S2, a sub-routine for the general sorter control is effected, while at step S3, a sub-routine for the copy paper sheet removal mode is executed. The copy paper sheet removal mode means the function for removal of the copy paper sheet accommodated in the respective bins 21 after completion of the sorting function.

Since the general sorter control effected in step S2 is similar to that in the conventional shiftable bin type sorting apparatus, it is not particularly shown in the form of a flow-chart, but will be briefly explained hereinbelow with reference to collating taken as an example.

Before the functioning, the respective bins are located at the home position with the uppermost bin 21 confronting the terminal end of the transport section 10. In the above state, when the first copy paper sheet is fed into the uppermost bin 21 from the transport section 10, the cam shafts 31 and 41 are each rotated by one rotation in the forward direction, thereby upwardly moving the respective bins by one pitch. Subsequently, the second copy paper sheet is accommodated into the subsequent bin 21 which then, confronts the terminal end of the tranport section 10. The functions as described above are repeated by the number of copy paper sheets to be taken.

For the sorting of the copy paper sheets for the second page of the original, each of the cam shafts 31 and 41 is rotated by one rotation in the reverse direction each time the copy paper sheet is accommodated in the bin 21, thereby to move the respective bins downwardly by one pitch. In other words, when the number of pages is in an odd number, the motor M2 is rotated in the forward direction to shift the bins 21 upwardly, while in the case where the number of pages is in an even number, the motor M2 is rotated in the reverse direction to shift the bins 21 downwardly.

Accordingly, upon completion of the sorting work for the page in the odd number, the respective bins 21 in which the copy paper sheets are accommodated are located at small pitch position at the upper stage, while upon completion of the sorting work for the page in the even number, the respective bins 21 are located at the home position.

The vertical shifting of the bins 21 is effected through detection of passing of the trailing edge for the copy paper sheet by the sensor Se1 provided at the transport section 10. In other words, when the sensor Se1 has detected the passing of the copy paper sheet trailing edge, it is regarded that the copy paper sheet is accommodated in the bin 21, and the vertical movment of the bin 21 is to be effected through a predetermined slight time delay after the above detection.

Figure 9:
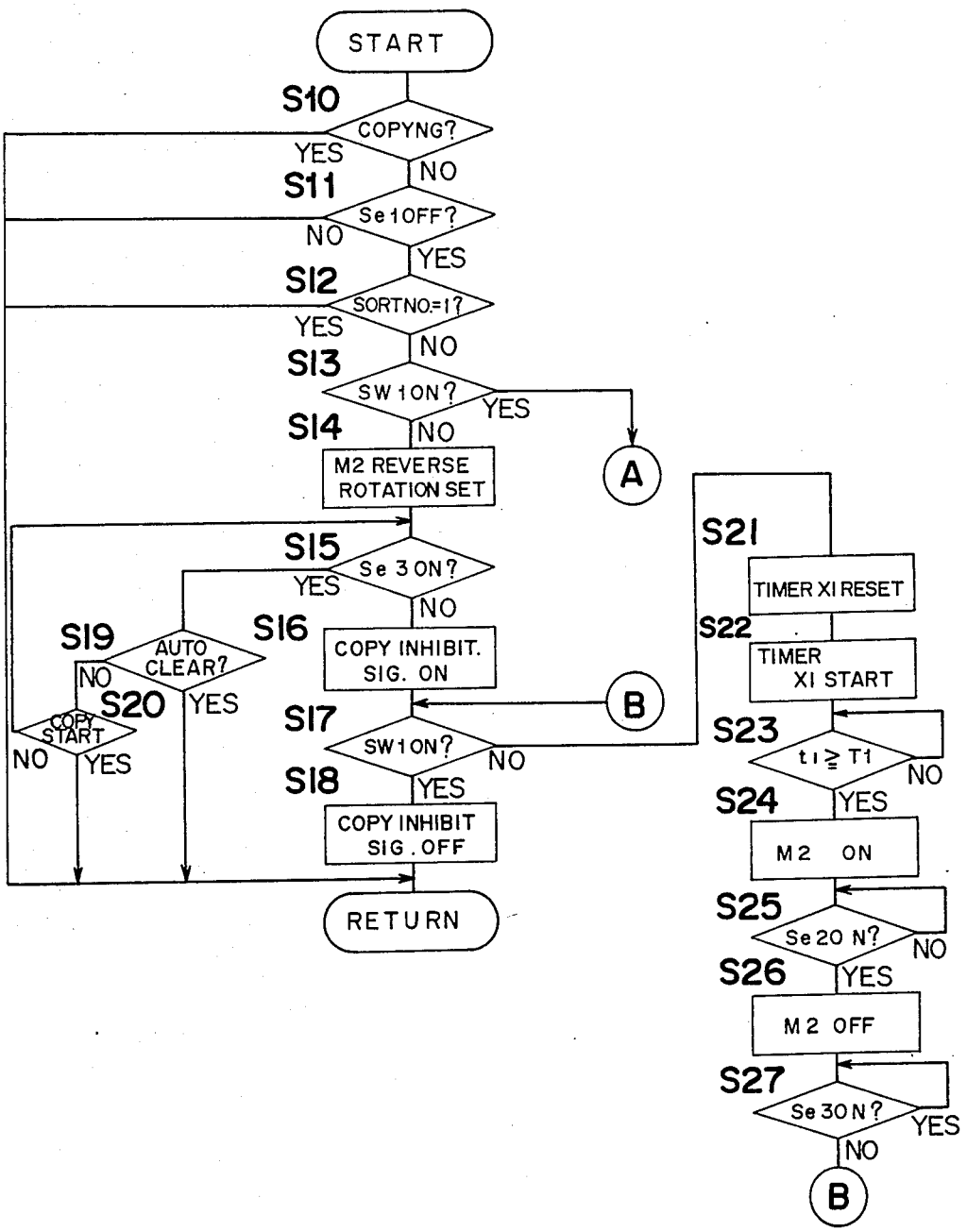
Figure 10:
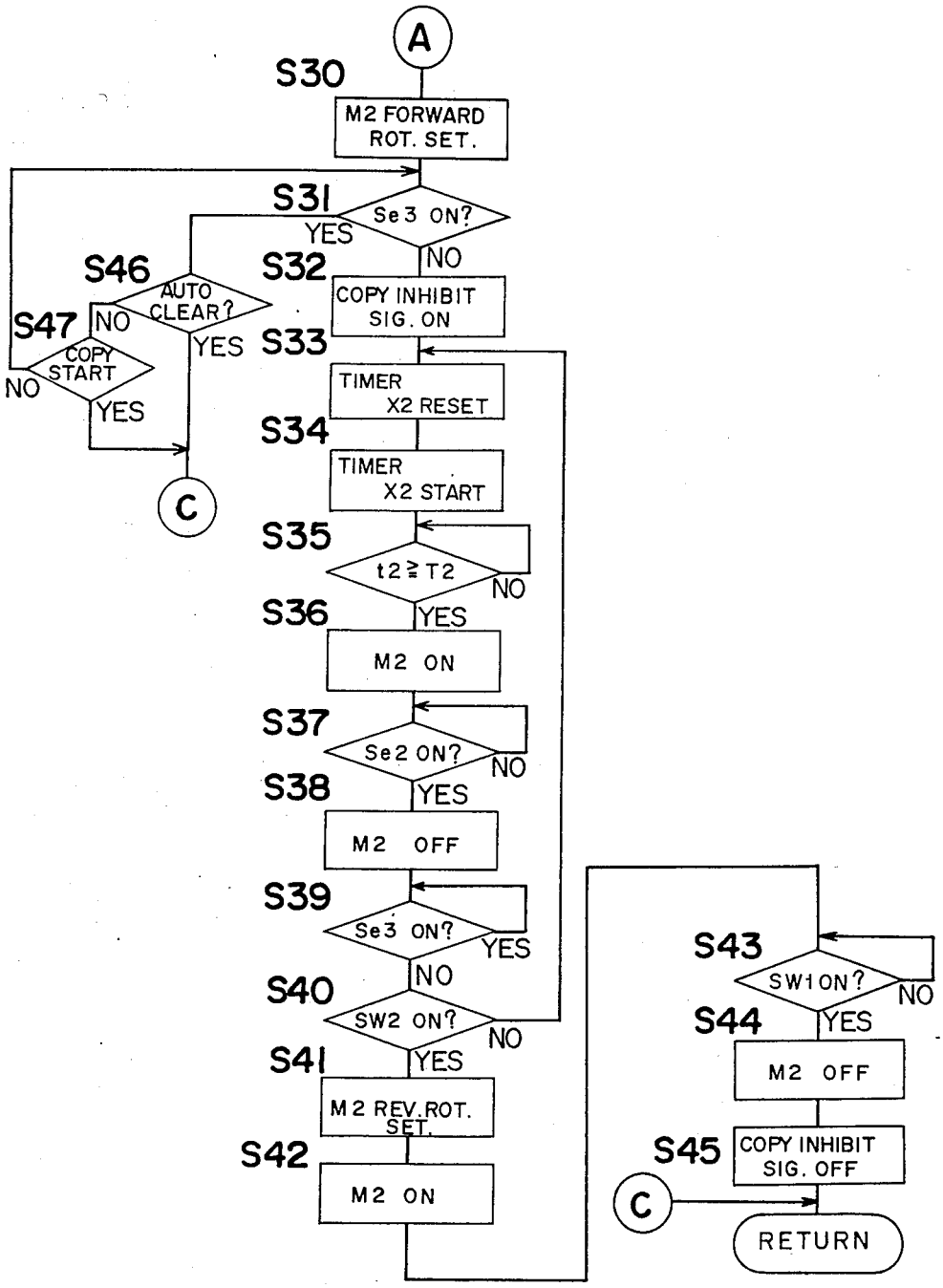
Figure 11:
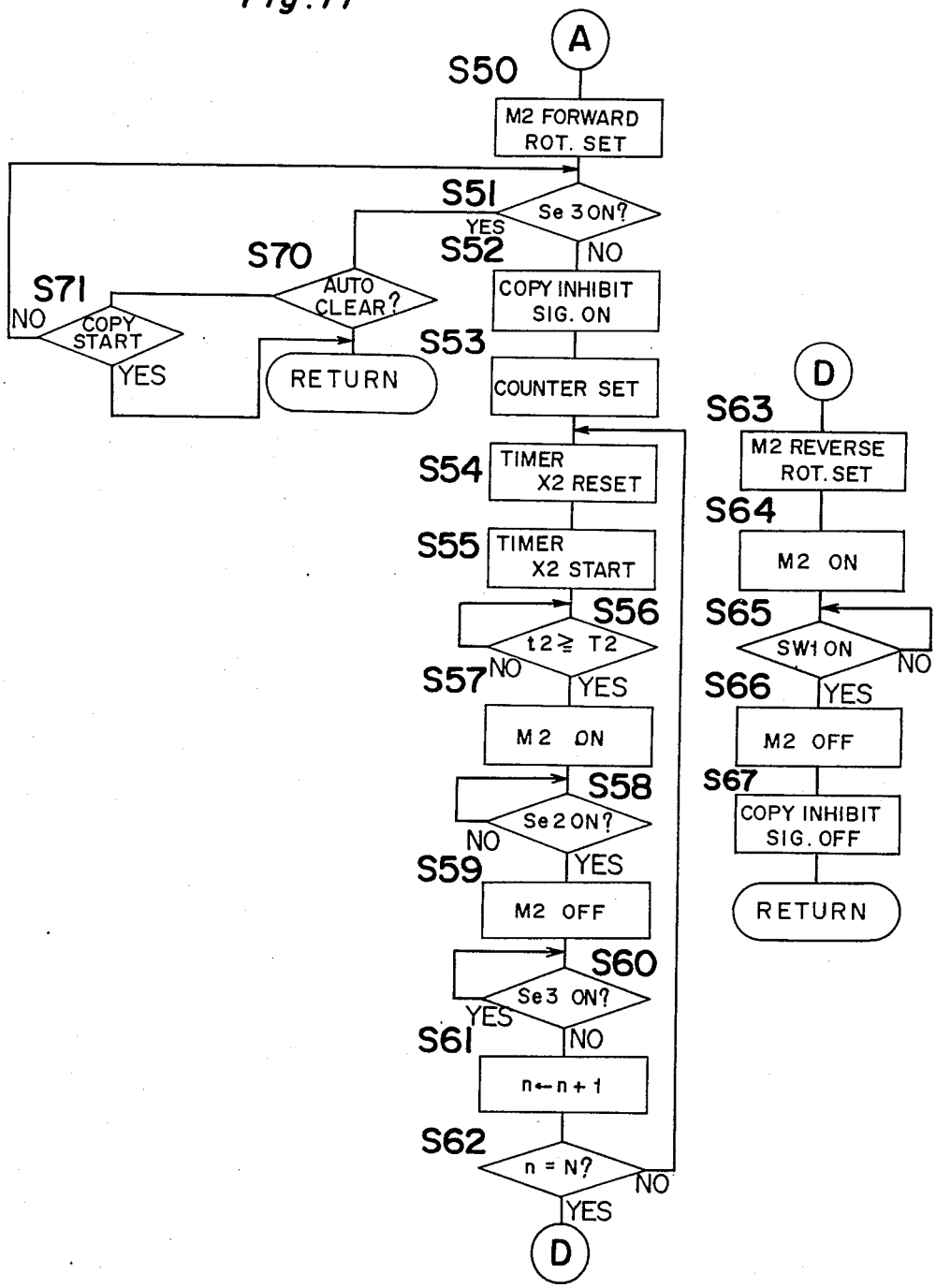

Referring particularly to FIGS. 9 through 11, the copy paper sheet removal mode to be effected at step S3 will be described in detail.

In the first place, at step S10, it is checked whether or not the copying is underway. The copying signal is emitted from the micro-computer of the copying apparatus 60, and if the copying is being effected, which means the judgment is "YES", the procedure is immediately returned to the main routine. Meanwhile, if the copying is not underway, which means the judgment is "NO", and it is then checked whether or not the sensor Se1 is off at step S11. The sensor Se1 is intended to detect the copy paper sheet passing through the transport section 10, and if the final copy paper sheet is still passing therethrough, which means the judgment is "NO" (the sensor Se1 is "on"), and the procedure reverts to the main routine. On the contrary, if the last copy paper sheet has passed through the transport section to turn off the sensor Se1, the judgement is "YES" and the step is shifted to step S12.

At step S12, checking is made as to whether or not the sorting number is "1". If it is "1", which means the sorting function is not being effected, the copy paper sheet removal mode is not required, so that the procedure is returned to the main routine. Meanwhile, if the sorting number is not "1", it is then checked whether or not the switch SW1 is "on" at step S13. This step S13 is intended to check whether or not the bins 21 are located at the home position, i.e., whether the number of collated pages is in the odd number or even number, and if the number is in the odd number, the bins 21 are not in the home position with the switch Sw1 turned off, while if it is in the even number, the bins 21 have been returned to the home position with the switch SW1 turned on. Thus, if the judgement is "YES", which means the bins 21 have been returned to the home position with the switch SW1 turned on, the procedure proceeds to step S30 and under to move the bins 21 upwardly for removal of the copy paper sheet. The judgment is "NO", which means the collating is effected in the odd number of times with the bins 21 shifted upward, the motor M2 is set for the reverse rotation at step S14. By the above operation, the bins 21 are successively shifted downwardly. Here, the operator is to remove the copy paper sheet from the bin 21 in which the last copy paper sheet is accommodated, i.e., from the bin confronting the terminal end of the transport section 10 and largely spaced from the bin located immediately thereabove.

The removal of the copy paper sheet is detected at the subsequent step S15 by checking whether or not the sensor Se3 is in the "on" state. If the sensor Se3 is "on", wihtout removing the copy paper sheet, the judgment is "YES", and at step S19, the procedure reverts to the main routine after waiting for an auto-clear signal to be emitted.

Hereinbelow, the auto-clear signal referred to above will be explained.

The auto-clear signal is emitted from the copying apparatus 60 by the termination of an auto-clear timer to be started upon completion of the copying operation by said copying apparatus 60. At step S19, up to the time when the auto-clealr signal is emitted, without removing the copy paper sheet from the bin (judgment is "NO" at step S19), on the assumption that the operator is in the vicinity of the copying apparatus to remove the sorted copy paper sheets or to newly start the copying, it is checked at subsequent step S20, whether or not the operator starts the copying operation. In the case where the operator starts copying, the copying start is detected by the rising of the copying signal from the copying apparatus. If the copying is not started at step S20, the procedure is reverted to step S15, and on the supposition that the operator is near the copying apparatus to remove the copy paper sheet, the control of the sorting apparatus is to be maintained at the copy paper sheet removal mode.

Meanwhile, if the copy paper sheet is not removed before emission of the auto-clear signal (judgment is "YES" at step S19), the copy paper sheet removal mode is released to make it possible to effect a separate copying function thereafter.

When the copy paper sheet is removed by the operator from the bin 21 in which the last copy paper sheet is accommodated before the emission of the auto-clear signal, the sensor Se3 is turned off ("NO" a step S15), and it is judged that the operator has started the removal of the copy paper sheet, so that a copying inhibition signal is applied to the micro-computer of the copying apparatus 60 at step S60.

Subsequently, at step S17 it is checked whether or not the switch Sw1 is in the "on" state. If the switch SW1 is "on" ("YES"), the bins 21 are returned to the home position. As a result, the copy paper sheet removal mode is not required, so that at step S18, the copying inhibition signal is turned off to return to the main routine. In the case where the switch SW1 is in the off state, i.e., when all the bins 21 have not been returned to the home position, a timer X1 is reset at step S21 so as to start said timer X1 at step S22, and after waiting for the count value t1 of the timer X1 to be counted up to a predetermined value T1 at step S23, the motor M2 is turned on at step S24, thereby to lower the bin 21 by one stage. This timer X1 is intended to restrict the downward movement of the bin 21 at step S24 immediately upon detection of removal of the copy paper sheet by the sensor Se3 so as to prevent the operator's hand from being caught between the bins, and the value T1 is set at such a sufficient value as to draw the operator's hand from the bin 21 after turning off of the sensor Se3

The downward shifting of the bin 21 by one stage is detected at step S25. More specifically, at step S25, by the turning on of the sensor Se2, it is detected that the cam shaft 41 is turned by one rotation, and the bins 21 have been shifted downwardly by one stage. Upon downward movement of the bins 21 by one stage, the motor M2 is subsequently turned off at step S26.

Subsequently, at step S27, it is again checked whether or not the sensor Se3 is in the "on" state, and after waiting for the sensor Se3 to be turned off ("NO"), i.e., waiting for the copy paper sheet to be removed, the procedure is returned to step S17 so as to repeat steps S21 through S27. More specifically, the bins 21 are downwardly shifted one stage by one stage, each time the copy paper sheet is removed, and when all the bins 21 have been returned to the home position ("YES" at step S17), the copy paper sheets are regarded as removed from all of said bins 21, and at step S18, the copying inhibition signal is turned off to return to the main routine.

On the other hand, when the judgment is "YES" at step S13, i.e., in the case where the bins 21 have been returned to the home position, with the collation in the even number of times effected, the motor M2 is set for the forward rotation at step S30 shown in FIG. 10. At this one later steps, the operator removes the copy paper sheet from the uppermost bin 21 in sequence thereafter.

At step S31, when the sensor Se3 is held in the "on" state, i.e., in the case where the auto-clear signal is turned on, without removing the copy paper sheet from the bin 21 ("YES" at step S46), the copy paper sheet removal mode is to be released for enabling separate functions to be effected, and the procedure reverts to the main routine. Meanwhile, in the case where the copy paper sheet is not removed without turning on the auto-clear signal ("NO" at step S46), at subsequent step S47, it is checked whether or not the copying is started, and if the copying is to be started again ("YES" at step S47), the procedure returns to the main routine. On the contrary, in the case where the copying is not started ("NO" at step S47), the procedure reverts to step S31, while the copy paper sheet removal mode is maintained.

When the copy paper sheet has been removed from the uppermost bin 21 by the operator, with the sensor Se3 turned off ("NO" at step S31), the copying inhibition signal is turned on at step S32, while a timer X2 is reset at step S33, and this timer X2 is started at step S34. Thus, after waiting for the count value t2 of the timer X2 to be counted up to a predetermined value T2 at step S35, the motor M2 is turned on at step S36 so as to shift the bins 21 upwardly by one stage. This timer X2 has the function similar to the timer X1 described earlier, and the value T2 generally corresponds to the value T1.

The upward shifting of the bins 21 by one stage is detected by the fact that the sensor Se2 is turned on ("YES") at step S37 due to turning of the cam shaft 41 by one rotation, and the motor M2 is turned off at step S38.

Subsequently, at step S39, it is checked again whether or not the sensor Se3 is in the "on" state, and after waiting for the sensor Se3 to be turned off ("NO"), i.e., waiting for the copy paper sheet to be removed, judgment is made as to whether or not the switch SW2 is in the "on" state at step S40. This step S40 is intended to check whether or not all the bins 21 are upwardly shifted up to the uppermost stage by the on/off state of the switch SW2, and if the switch SW2 is not turned on ("NO" at step S40), the procedure is reverted to step S33, and thus, steps S33 to S40 are repeated until the switch SW2 is turned on. More specifically, the bins 21 are shifted upwardly one stage by one stage each time the copy paper sheet is removed, and when all of the bins 21 have been moved up to the uppermost stage, it may be regarded that the copy paper sheets have been removed from all of said bins. When the switch SW2 is turned on, which means judgment is "YES" at step S40, the motor M2 is set for the reverse rotation at step S41 so as to be turned on at step S42 for shifting the bins 21 downwardly.

Subsequently, at step S43, after waiting for the switch SW1 to be turned on, i.e., waiting for the bins 21 to be returned to the home position, the motor M2 is turned off at step S44, while at step S45, the copying inhibition signal is also turned off, whereby the copy paper sheet removal mode is terminated to return to the main routine.

It is to be noted here that in the case of the one direction collating or grouping, the function in the case where the number of pages is in the odd number is to be effected (steps S14 through S26).

Incidentally, in the copy paper sheet removal mode as described so far, when the collating is in the even number, i.e., when the bins 21 are located at the home position, all the bins 21 must be raised even when the sorting number is small, for example, "2" (steps S33 through S40). Considering the above fact, there is provided another copy paper sheet removal mode as explained hereinbelow, in which in the case where the collating is in the even number, only the used bin 21 is shifted upwardly with the omission of the operation for unused bins. The above copy paper sheet removal mode is effected as in the flow-chart of FIG. 9 when the number at the initial stage of starting and at the collating is in the odd number, and after having been judged as "YES" at step S13 therein, the procedure is shifted to the flow-chart shown in FIG. 11.

More specifically, when it is ensured that the bins 21 have been returned to the home position at the above step S13, the motor M2 is set for the forward rotation at step S50. At step S51, after waiting for the operator to remove the copy paper sheet from the uppermost bin 21 ("NO" at this step S51), the copying inhibition signal is turned on at step S52.

It is to be noted here that at step S51, when the auto-clear signal is turned on with the sensor Se3 held in the "on" state ("YES" at step S70), the procedure is returned to the main routine.

In the case where the auto-clear signal is not turned on with the sensor Se3 remaining in the "on" state ("NO" at step S70), judgment is made at step S71 as to whether or not the copying is started. If the copying is to be started ("YES" at step S71), the procedure is returned to the main routine, while when the copying is not to be started ("NO" at step S71), the copy paper sheet removal mode is maintained.

When the copying inhibition signal is turned on at step S52 after the judment of "NO" at step S51, a multiple copy number N is set in the counter at step S53 for the purpose of comparing the number of the bins 21 shifting upwardly with the multiple copy number N at the subsequent routine. Subsequently, at multiple copy S54, the timer X2 is reset so as to be started at step S55. Then, at step S56, after waiting for the count value t2 of the timer X2 to be counted up to the predetermined value T2, the motor M2 is turned on at step S57, while when the sensor Se2 is turned on at step S58, the motor M2 is turned off at step S59 with the bin 21 being shifted upwardly by one stage.

Subsequently, at step S60, it is again checked whether or not the sensor Se3 is in the "on" state, and after waiting for the copy paper sheet to be removed ("NO" at step S60), the count value n of the counter is counted up by "1" at step S61 for the comparison of the count value n with the multiple copy number N at step S62.

If the count value n is not equal to the multiple copy number N, which means that the copy paper sheet is still left unremoved in the bin 21, steps S54 through S62 are repeated until the count value n becomes equal to the multiple copy number N. The judgment is of "YES" at step S62, i.e., the agreement between count value n and the multiple copy number N indicates that the copy paper sheets have been removed from all the bins 21 used for the sorting.

Accordingly, at step S63, the motor M2 is set for the reverse rotation so as to be turned on at step S64 for downward shifting of the bins 21. Thus, after waiting for the switch SW1 to be turned on at step S65, the motor M2 is turned off at step S66, while the copying inhibition signal is also turned off at step S67, whereby the copy paper sheet removal mode is terminated to return to the main routine.

It should be noted here that, in the copy paper sheet removal mode as described so far, although the function to automatically shift the bins for removing the copy paper sheets becomes operable after the auto-clearing, it may be so modified that a switch instructing the function for automatically shifting the bins 21 is separately provided for effecting the function upon turning on of said switch.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A sorting apparatus of a shiftable bin type which has a plurality of bins which successively receive copy paper sheets from a sheet outlet of a transport section for sorting thereof, inlet ends of said bins being so arranged as to move progressively past the sheet outlet in opposite directions, and a bin shifting means for shifting the respective bins so that said bins are located close together when positioned at either side of said sheet outlet, but is largely spaced from the bin located immediately thereabove when positioned to accommodate the incoming sheet from said sheet outlet, said sorting apparatus comprising:

a first detecting means for detecting presence or absence of copy paper sheets on said bins to emit a signal, and a control means for controlling said bin shifting means in such a manner that, after completion of sorting, upon detection by said first detecting means that the copy paper sheet has been removed from the bin confronting said sheet outlet, said bin shifting means moves the subsequent bin containing the copy paper sheet to the position confronting said sheet outlet in response to the signal of said first detecting means.

2. A sorting apparatus as claimed in claim 1, wherein said control means includes a second detecting means which detects that each of said bins has been shifted upwardly or downwardly by one stage with respect to said sheet outlet for emitting a signal, said bin shifting means being operated by the signal from said first detecting means, after detecting that the copy paper sheet has been removed from the bin, and being stopped by the signal from said second detecting means.

3. A sorting apparatus as claimed in claim 1, wherein said control means further includes a third detecting means which detects at which side of upper or lower side with respect to said sheet outlet said bins containing the copy paper sheet are positioned, thereby to emit a signal, said bins being so controlled as to be moved to any one side progressively past said sheet outlet in opposite directions in response to the signal from said third detecting means.

4. A sorting apparatus as claimed in claim 2, wherein said control means controls so as to move the respective bins downwardly by one stage when said bins are located at the upper side with respect to the sheet outlet, and to move the respective bins upwardly by one stage when said bins are located at the lower side with respect to said sheet outlet, after detection that the copy paper sheet has been removed from the bin by the signal from said first detecting means, said control being effected to the respective bins per each signal from said first detecting means, thereby to ultimately shift all the bins to predetermined position with respect to said sheet outlet.

5. A sorting apparatus as claimed in claim 2, wherein said bin shifting means includes a rotary member engageable with the successive bins for effecting the shifting of said bins in a longitudinal direction with respect to the sheet outlet, said second detecting means being a sensor means for detecting rotation of said rotary member.

6. A sorting apparatus as claimed in claim 2, wherein said control means includes means for memorizing the number of bins in which copy paper sheets are accommodated, and means for counting the number of bins moving toward the upper side or lower side of said sheet outlet one stage by one stage, per each detection that the copy paper sheet has been removed from the bin, by the signal from said first detecting means.

7. A sorting apparatus as claimed in claim 6, wherein said control means so controls as to move the respective bins containing copy paper sheets toward the upper side or lower side of the sheet outlet one stage by one stage, per each detection that the copy paper sheet has been removed from the bin, by the signal from said first detecting means, thereby to ultimately shift the bins equal in number to the memorized value of the number of bins.

8. A sorting apparatus as claimed in claim 7, wherein said control means is arranged to move all the bins to the predetermined positions after said memorized value and said count value have become equal to each other.

9. A sorting apparatus as claimed in claim 1, wherein said first detecting means includes a light emitting element and a light receiving element disposed side by side at said sheet outlet, so as to confront a light absorbing portion disposed on the bin when said bin confronts said sheet outlet.

10. A sorting apparatus as claimed in claim 1, wherein said first detecting means is disposed at a position where it is possible to detect the copy paper sheet of the minimum size to be sorted on the bins.

11. A sorting apparatus of a shiftable bin type which has a plurality of bins which successively receive copy paper sheets from an sheet outlet for sorting thereof, inlet ends of said bins being so arranged as to move progressively past the sheet outlet in opposite directions, and a bin shifting means for shifting the respective bins so that said bins are located close together when positioned at either side of said sheet outlet, but is largely spaced from the bin located immediately thereabove when positioned to accommodate the incoming sheet from said sheet outlet, said sorting apparatus comprising:

a first detecting means for detecting presence or absence of copy sheets on the bin confronting said sheet outlet to emit a signal, and a control means for controlling said bin shifting means in such a manner that, after completion of sorting, upon detection by said first detecting means that the copy paper sheet has been removed from the bin confronting said sheet outlet, said bin shifting means moves the subsequent bin containing the copy paper sheet to the position confronting said sheet outlet in response to the signal of said first detecting means, thereby effecting said control with respect to the respective bins so as to ultimately position all the bins at upper or lower side with respect to said sheet outlet.

12. A sorting apparatus as claimed in claim 11, wherein said control means includes a second detecting means which detects that each of said bins has been shifted upwardly or downwardlly by one step with respect to said sheet outlet for emitting a signal, said bin shifting means being operated by the signal from said first detecting means, after detecting that the copy paper sheet has been removed from the bins, and being stopped by the signal from said second detecting means.

13. A sorting apparatus as claimed in claim 11, wherein said control means further includes a third detecting means which is constituted by a set of detecting members provided at opposite ends of the bin shifting passage, one of said detecting members producing a signal for determining the shifting direction of said bin depending on which side of the upper side or lower side with respect to said sheet outlet, said bin containing the copy paper sheet is located, with the other of said detecting members producing a signal corresponding to completion of the shifting of said bin, said control means shifting said bin toward the upper side or lower side with respect to said sheet outlet corresponding to the shifting direction of the bin to be determined by the signal from the one of said detecting members for said third detecting means.

14. A sorting apparatus as claimed in claim 12, wherein said control means controls so as to move the respective bins downwardly by one stage when said bins are located at the upper side with respect to the sheet outlet, and to move the respective bins upwardly by one stage when said bins are located at the lower side with respect to said sheet outlet, after detection that the copy paper sheet has been removed from the bin confronting the sheet outlet by the signal from said first detecting means, said control being effected to the respective bins per each signal from said first detecting means, thereby to ultimately shift all the bins to predetermined position with respect to said sheet outlet.

15. A sorting apparatus as claimed in claim 12, wherein said bin shifting means includes a rotary member engageable with the successive bins for effecting the shifting of said bins in a longitudinal direction with respect to the sheet outlet, said second detecting means being a sensor means for detecting rotation of said rotary member.

16. A sorting appartus as claimed in claim 11, wherein said first detecting means includes a light emitting element and a light receiving element disposed side by side at said sheet outlet, so as to confront a light absorbing portion disposed on the bin when said bin confronts said sheet outlet.

17. A sorting apparatus as claimed in claim 11, wherein said first detecting means is disposed at a position where it is possible to detect the copy paper sheet in the smallest size of the copy paper sheets to be sorted on the bins.

18. A sorting apparatus of a shiftable bin type which has a plurality of bins which successively receive copy paper sheets from a sheet outlet for sorting thereof, inlet ends of said bins being so arranged as to move progressively past the sheet outlet in opposite directions, and a bin shifting means for shifting the respective bins so that each of said bins is located close to other bins when positioned at either side of said sheet outlet, but is largely spaced from the bin located immediately thereabove when positioned to accommodate the incoming sheet from said sheet outlet, said sorting apparatus comprising:

a first detecting means for detecting presence or absence of copy paper sheets on the bin confronting said sheet outlet to emit a signal, and a control means for controlling said bin shifting means in such a manner that, after completion of sorting, upon detection by said first detecting means that the copy paper sheet has been removed from the bin confronting said sheet outlet, said bin shifting means moves the subsequent bin containing the copy paper sheet to the position confronting said sheet outlet in response to the signal of said first detecting means, thereby effecting said control with respect to all the bins in which the copy paper sheets are accommodated.

19. A sorting apparatus as claimed in claim 18, wherein said control means includes a second detecting means which detects that each of said bins has been shifted upwardly or downwardly by one step with respect to said sheet outlet for emitting a signal, said bin shifting emans being operated by the signal from said first detecting means, after detecting that the copy paper sheet has been removed from the bin, and being stopped by the signal from said second detecting means.

20. A sorting apparatus as claimed in claim 18, wherein said control means further includes a third detecting means which is constituted by a set of detecting members provided at opposite ends of the bin shifting passage, one of said detecting members producing a signal for determining the shifting direction of said bin depending on which side of the upper side or lower side with respect to said sheet outlet, said bin containing the copy paper sheet is located, with the other of said detecting members producing a signal corresponding to completion of the shifting of said bin, said control means shifting said bin toward the upper side or lower side with respect to said sheet outlet correspondong to the shifting direction of the bin to be determined by the signal from the one of said detecting members for said third detecting means.

21. A sorting apparatus as claimed in claim 19, wherein said bin shifting means includes a rotary member engageable with the successive bins for effecting the shifting of said bins in a longitudinal direction with respect to the sheet outlet for detecting rotation of said rotary member.

22. A sorting apparatus as claimed in claim 19, wherein said control means includes means for memorizing the number of bins in which copy paper sheets are accommodated, and means for counting the number of bins moving toward the upper side or lower side of said sheet outlet one stage by one stage, per each detection that the copy paper sheet has been removed from the bin, by the signal from said first detecting means.

23. A sorting apparatus as claimed in claim 22, wherein said control means so controls as to move the respective bins containing copy paper sheets toward the upper side or lower side of the sheet outlet one stage by one stage, per each detection that the copy paper sheet has been removed from the bin containing the copy paper sheet by the signal from said first detecting means, thereby to ultimately shift the bins equal in number to the memorized value of the number of bins.

24. A sorting apparatus as claimed in claim 22, wherein said control means is arranged to move all the bins to the predetermined positions after said memorized value and said count value have become equal to each other.

25. A sorting apparatus as claimed in claim 18, wherein said first detecting means inlcudes a light emitting element and a light receiving element disposed side by side at said sheet outlet, so as to confront a light absorbing portion disposed on the bin when said bin confronts said sheet outlet.

26. A sorting apparatus as claimed in claim 18, wherein said first detecting means is disposed at a position where it is possible to detect the copy paper sheet of the minimum size to be sorted on the bins.

* * * * *